US005697509A

United States Patent [19]

Hayes

[11] Patent Number: 5,697,509

[45] Date of Patent: Dec. 16, 1997

[54] HINGED TAMPER-EVIDENCING CLOSURE

[75] Inventor: Thomas H. Hayes, Loveland, Ohio

[73] Assignee: Anchor Hocking Packaging Company, Lancaster, Ohio

[21] Appl. No.: 791,013

[22] Filed: Jan. 27, 1997

Related U.S. Application Data

[63] Continuation of Ser. No. 262,587, Jun. 20, 1994, abandoned.

[51] Int. Cl.[6] ..... B65D 17/40

[52] U.S. Cl. ..... 215/235; 215/253; 215/258; 220/335; 220/339

[58] Field of Search ..... 215/316, 235, 215/253, 258; 220/339, 335, 259

[56] References Cited

U.S. PATENT DOCUMENTS

| | | |
|---|---|---|
| 852,519 | 5/1907 | Nee . |
| 1,863,081 | 6/1932 | Bellows . |
| 1,996,554 | 4/1935 | Shearwood . |
| 2,669,369 | 2/1954 | Towns . |
| 3,067,899 | 12/1962 | Everett . |
| 3,171,561 | 3/1965 | MacLean . |
| 3,254,785 | 6/1966 | Lovell . |
| 3,285,451 | 11/1966 | Golde . |
| 3,292,807 | 12/1966 | Golde . |
| 3,300,073 | 1/1967 | Benz . |
| 3,379,327 | 4/1968 | Link et al. . |
| 3,412,890 | 11/1968 | Rich . |
| 3,421,654 | 1/1969 | Hexel . |
| 3,434,613 | 3/1969 | Langecker . |
| 3,473,685 | 10/1969 | Karlan . |
| 3,603,473 | 9/1971 | Winberg . |
| 3,625,386 | 12/1971 | Schaefer . |
| 3,899,097 | 8/1975 | Aichinger . |
| 4,060,172 | 11/1977 | Amabili . |
| 4,200,196 | 4/1980 | Bashour . |
| 4,354,610 | 10/1982 | Kessler et al. . |
| 4,358,032 | 11/1982 | Libit . |
| 4,362,253 | 12/1982 | Wortley et al. . |
| 4,371,095 | 2/1983 | Montgomery et al. . |
| 4,403,712 | 9/1983 | Wiesinger . |
| 4,503,991 | 3/1985 | Joyce . |
| 4,616,761 | 10/1986 | Nolan . |
| 4,726,091 | 2/1988 | Joyce . |
| 4,881,668 | 11/1989 | Kitterman et al. . |
| 5,251,770 | 10/1993 | Bartley et al. . |
| 5,292,017 | 3/1994 | Reifers . |

FOREIGN PATENT DOCUMENTS

| | | |
|---|---|---|
| 0569747 | 11/1993 | European Pat. Off. . |
| 2689101 | 10/1993 | France . |
| 849964 | 7/1949 | Germany . |
| 440108 | 12/1967 | Switzerland . |
| 19794 | of 1905 | United Kingdom . |
| 939088 | 10/1963 | United Kingdom . |
| 9014286 | 11/1990 | WIPO . |

*Primary Examiner*—Joseph M. Moy
*Attorney, Agent, or Firm*—Wood, Herron & Evans, L.L.P.

[57] ABSTRACT

An all-plastic, hinged, tamper-evidencing closure includes an upper closure surface or top with a hinge formed therein. The hinge may be a straight line, or curved or arcuate so as to provide a snap-action for opening and closing. The closure includes a peripherally depending skirt which has structure for removably retaining the closure on a container, such as a snap head or threads. Additionally, the skirt includes tamper-evidencing structure. The closure top surface may be planar, concave or convex, or it may be initially planar, but when subject to vacuum or pressure it becomes concave or convex, respectively. This latter feature provide a visual indicator that the vacuum seal or pressure seal of the container is intact.

3 Claims, 3 Drawing Sheets

HINGED TAMPER-EVIDENCING CLOSURE

This application is a continuation of U.S. patent application Ser. No. 08/262,587, filed Jun. 20, 1994 now abandoned.

FIELD OF THE INVENTION

The invention relates to a plastic closure for containers, and more particularly to a hinged, tamper-evidencing closure which is readily opened and resealed.

BACKGROUND OF THE INVENTION

Hinged or foldable closures for containers are known and examples of such closures are shown in U.S. Pat. Nos. 852,519, 1,996,554, 4,060,172, 4,362,253, and 4,503,991, as well as a German patent number 849,964 and UK Patent Application No. 19,794. The closures disclosed in several of these patents are metal, require a tool for opening, which must be properly aligned relative to the hinge line, and are not resealable. In addition, one or more of these hinged closures do not include any means for evidencing tampering with the container. Since current packaging regulations call for reliable tamper-evidencing means associated with packaging, including closures, the absence of such tamper-evidencing structure in prior art closures may render them unacceptable for use today.

With specific reference to U.S. Pat. No. 4,362,253, there is shown a flexible plastic closure which deforms along a line across the closure, but does not include a hinge. A closure such as that shown in the '253 patent has a drawback in that upon release after flexing to open the closure will spring back to its pre-flexed shape. Thus, this type of cap is apparently not capable of being pried open, yet being retained on the container for pouring out the contents or drinking therefrom.

What is needed is a low-cost, one-piece, plastic tamper-evidencing closure which facilitates easy opening and closing thereof, and which may remain fixed on the container yet have a pry-open portion thereof to access the container contents.

SUMMARY OF THE INVENTION

In its broadest aspects, the invention contemplates a plastic, tamper-evidencing hinged closure for containers. The closure may be of the press-on or thread or screw-on type and provides a low-cost, one-piece closure with tamper-evidencing capability. The hinge of the closure facilitates opening and accessing the contents of the container to which the closure is applied. This may be done with or without completely removing the closure from the container. Once the contents of the container have been dispensed, the closure permits simple resealing.

In one desirable embodiment, the closure of the present invention includes an upper closure surface having a hinge which permits flexing a portion of the closure about the hinge for opening and closing the closure. The closure further includes a peripheral skirt depending downwardly from the upper closure surface. The skirt may include lugs (for press-on closures) or threads (for twist-on or screw-on closures, which will be generally referenced as thread-on closures) for retaining the closure on a container. The closure further includes tamper-evidencing means which is perceptibly disturbed upon first opening of the closure to indicate that it has been previously opened or tampered with. To facilitate opening the closure, a tab member is provided which extends out from the skirt for a user to engage with a thumb or finger to pry open the closure.

It is contemplated that the upper closure surface may be planar and that the hinge bisects the planar upper closure surface along a diameter line thereof. Alternatively, the hinge may bisect the planar closure surface along a chord line thereof; in this embodiment, the portion of the closure which is not flexed or swing about the hinge comprises grater than half of the closure surface. With this latter configuration, the closure will be retained on the container unless pried off completely, and is not susceptible to being slid off of the container finish in a direction perpendicular to the central axis of the container. In yet another alternative, the hinge bisects the planar upper closure surface along a curved line that is within the plane of the upper surface. This hinge structure provides a snap-open, spring-closed action as the closure portion swings through an upright orientation.

Also contemplated is a concave or convex upper closure surface such that the hinge follows an arcuate line. These configurations will also provide a snap-open, spring-closed hinge action. Furthermore, the closure may be manufactured with an upper closure surface that is generally planar, but is sufficiently flexible due to its thickness and/or the material used so that it will flex to a concave or convex orientation when subject to vacuum or pressure. More particularly, a closure of this type, when applied in a hot-filling operation, will be subject to a vacuum upon cooling of the container contents. The flexible web of the upper closure surface will flex downwardly to a concave orientation, which serves a dual function. First, the hinge line will become arcuate, thereby providing the desired snap-open, spring closed action. And second, the closure will initially (i.e., immediately subsequent to filling the container) evidence the integrity of the vacuum seal. The upper closure surface will then cold-set in the concave orientation. Analogously, when the container is for a pressure-packed product (such as a carbonated beverage, for example) the upper closure surface will flex or bow upwardly to a convex orientation. This also results in an arcuate hinge line and evidences the initial integrity of the pressure seal.

Various tamper-evidencing structures are contemplated for use in the closure of the present invention. One example is deformable or frangible webs or other lines of weakness in the peripheral skirt of the closure adjacent the two ends of the hinge. In this embodiment, as the closure is flexed about the hinge line, the deformable or frangible webs or lines of weakness are deformed or torn and thus evidence that the enclosure has been opened. Alternatively, tamper-evidencing may be accomplished by a removable tear strip section in the peripheral skirt which must be removed prior to prying the closure open. Yet another alternative tamper-evidencing structure comprises one or more frangible bridges connecting sections of the peripheral skirt across a slit or gap such that as the closure is flexed or swung about the hinge the frangible members are ruptured, thereby indicating that the closure has been opened.

These and other features and advantages of the present invention will be best understood with reference to the accompanying drawings and the detailed description which follows.

DETAILED DESCRIPTION OF THE INVENTION

Figure 1:
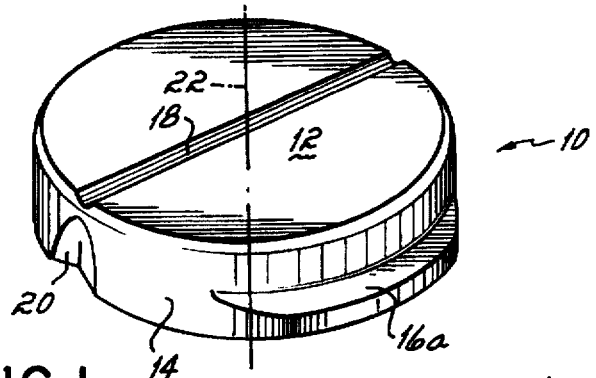
FIG. 1 is a perspective view of one embodiment of the closure of the present invention.
Figure 2:
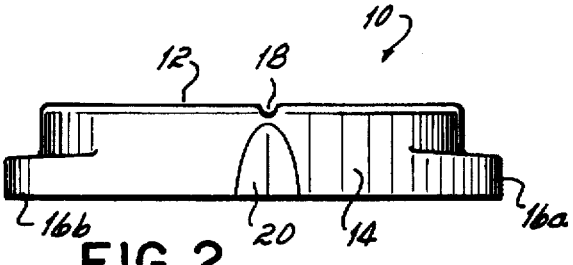
FIG. 2 is a side elevation of the closure of FIG. 1.
Figure 3:
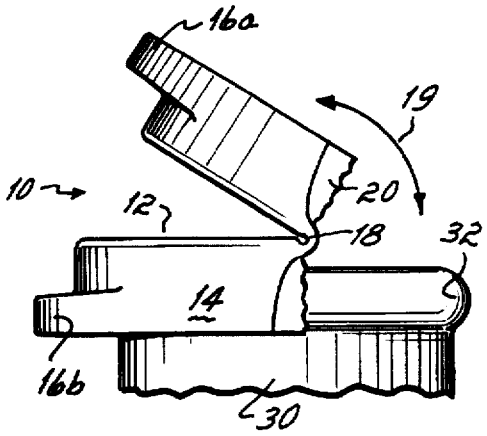
FIG. 3 is a side elevation, partially broken away, showing the closure of FIG. 2 applied to a container and in an open orientation.

A first embodiment of the present invention is shown in FIGS. 1 through 3. Closure 10, which is preferably an all-plastic, one-piece article, includes a generally planar or flat top or upper closure surface 12, a peripheral or annual skirt 14 depending from closure top 12 and one or more tab members 16*a*, 16*b* which extend generally outwardly from skirt 14. A hinge 18 is formed or molded in closure top 12, such as by providing a line of reduced thickness, and facilitates flexing or swinging the closure about hinge 18. To further facilitate opening and closing of closure 10 and to provide tamper-evidencing, two lines of weakness or deformable webs 20 (only one shown) are formed in peripheral skirt 14 at locations adjacent to the ends of hinge 18. These deformable webs or lines of weakness are preferably frangible and are generally parallel to a central axis 22 of closure 10.

As shown more particularly in FIG. 3, closure 10 may be of the press-on type, in which case it is retained on a container 30 by means of a continuous circumferential bead (not explicitly shown) or a plurality of circumferential bead segments or lugs which snap over a bead 32 on the container finish. In use, a person pries a portion of closure 10 upwardly away from engagement with the container finish, as by applying an upward force on either tab 16*a* or 16*b*. This upward force causes the closure to flex, pivot or swing about hinge 18, thereby opening the closure, as indicated by arrow 19 in FIG. 3. Closure skirt 14 will yield or flex slightly outwardly during this pry-opening so as to disengage from bead 32. The deformable lines of weakness 20 are either deformed or ruptured during this pry-open action, and thus provide visual evidence that the closure has been opened. The container can be resealed by swinging the open position of closure 10 to a closed position wherein it re-engages bead 32 of container 30.

Figure 4:
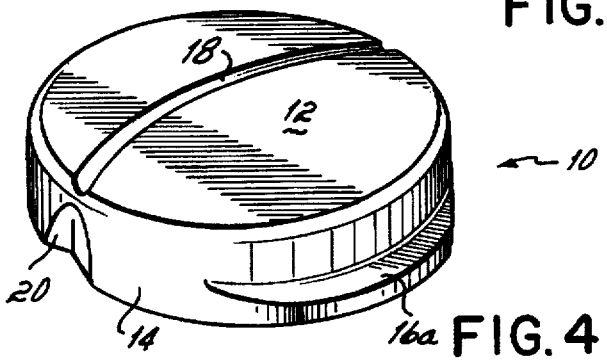
FIG. 4 is a perspective view of an alternative embodiment of the closure of the present invention.

In an alternative embodiment shown in FIG. 4, hinge 18 is arcuate or curved and lies in the plane of closure top 12. With an arcuate hinge 18, opening the closure by pivoting or swinging a portion thereof about hinge 18 causes a snap action which tends to snap-open and retain closure 10 in an open position. When closure 10 is being closed, the snap-action of the hinge will tend to spring the closure to a closed position.

Figure 5:
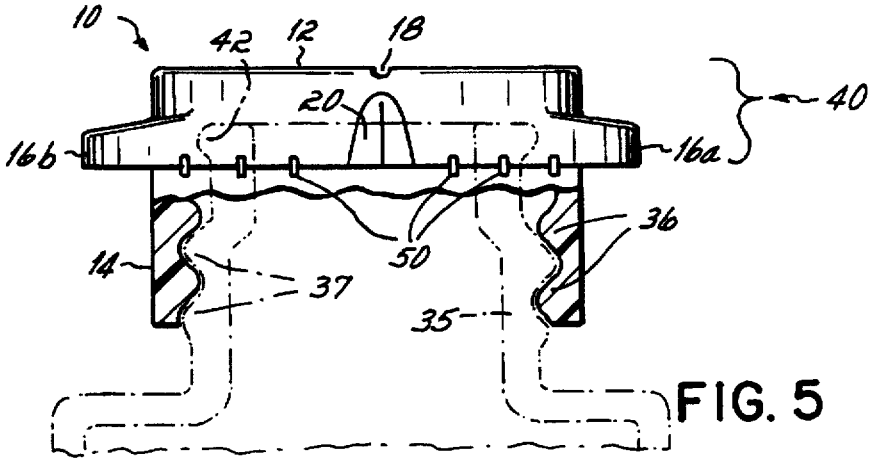
FIG. 5 is a side elevation, in partial cross-section, showing an alternative closure of the present invention applied to a container (phantom)

FIG. 5 shows an alternative closure embodiment wherein closure 10 is threaded or screwed onto a container finish 35 by means of threads 36 on the inside of closure skirt 14 which engage threads 38 on container finish 35. The upper portion 40 of closure 10 snaps over a bead 42 (shown in phantom) such that closure 10 is manipulated in a manner similar to the closure depicted in FIG. 3. I.e., by applying upward force on one of tabs 16*a* or 16*b* to pivot the closure open about hinge 18. If desired, the entire closure 10 can be removed by threading it off of container finish 35, or the container contents can be accessed by simply opening and closing the upper closure portion 40 by pivoting a section thereof about hinge 18. Again, tamper-evidencing lines of weakness 20 may be utilized, and in addition, bridges 50 spaced about the outer perimeter of closure 10, connecting upper portions 40 and skirt 14 further provide tamper-evidencing. As the closure is opened by pivoting a portion thereof about hinge 18, bridges 50 are ruptured and provide evidence of tampering.

Figure 6:
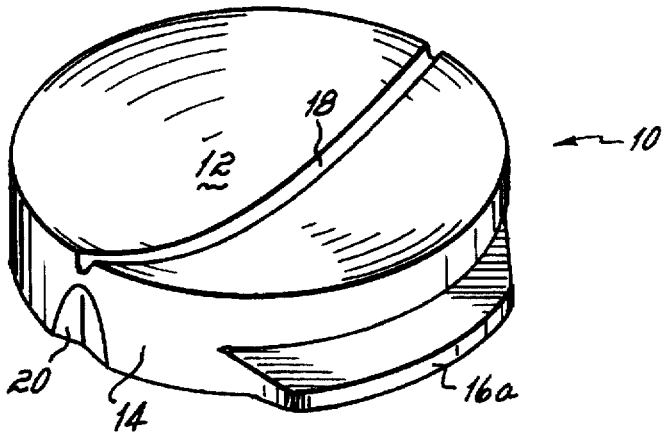
FIG. 6 is a perspective view of yet another alternative closure of the present invention.

In an alternative embodiment shown in FIG. 6, upper closure surface 12 is concave and hinge 18 follows an arcuate path. With this configuration, as the closure is opened, the arcuate hinge creates a snap-action which tends to snap or spring the closure open or closed as it swings through an over-center position. Alternatively, although not explicitly shown, upper closure surface 12 may be bowed upwardly to a convex orientation to also provide an arcuate hinge 18, which will likewise provide a snap-action upon opening and closing of closure 10.

Figure 7:
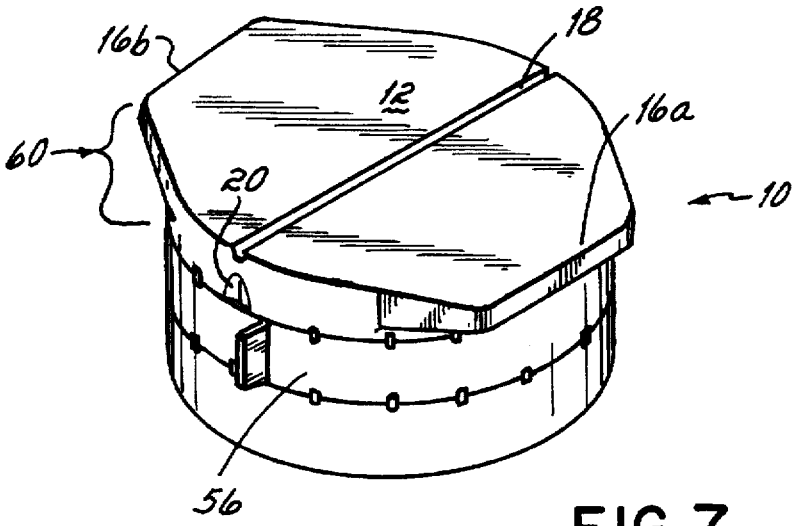
FIG. 7 is a perspective view of yet another closure of the present invention.
Figure 8:
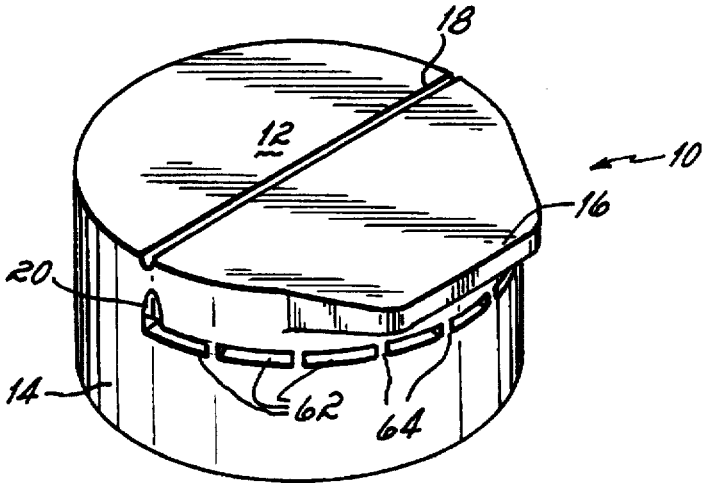
FIG. 8 is a perspective view of still another alternative closure according to the present invention.

FIGS. 7 and 8 show further an alternative embodiments of the invention wherein tamper evidencing means such as a tear strip 56 (FIG. 7) is initially torn from closure 10 and discarded. Thereafter the closure upper portion 60 is manipulated in the same manner as described above with respect to FIGS. 1–3. In this embodiment, the closure may be a press-on or thread-on type. In the embodiment shown in FIG. 8, peripheral skirt 14 has a plurality of slots 62 formed therein which are separated by frangible bridges 64 such that as upward pressure is applied via tab 16, bridges 64 are broken, thus allowing the closure to be opened and providing tamper-evidencing means.

With respect to the foregoing embodiments, it will be appreciated that hinge 18 may be a substantially straight line hinge as shown in FIG. 1, or a curved line hinge as shown in FIG. 4. Additionally, upper closure surface 12 may be generally planar as shown in FIGS. 1–5, or it may be concave as shown in FIG. 6 or convex (not explicitly shown). If upper surface 12 is concave or convex, then hinge 18 will be arcuate so as to provide the snap-action described hereinabove.

Figure 9:
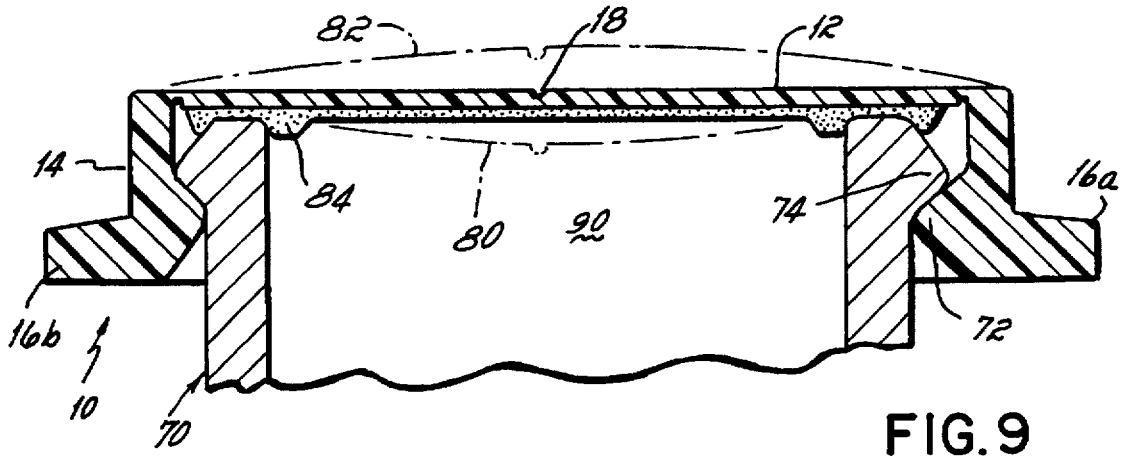
FIG. 9 is a side-elevation, in partial phantom and cross-section, showing a closure of the present invention in several orientations.

With reference to FIG. 9, a preferred embodiment of the closure of the present invention is shown. In this embodiment, closure 10 is retained on a container 70 by means of a snap bead 72 which engages a bead 74 on the container finish. Closure 10 includes tabs 16*a* and 16*b* to be utilized in opening and closing the closure. Upper closure surface 12 is sufficiently flexible and of a thickness which permits flexing from a generally flat or planar orientation to a concave or convex orientation shown in phantom by lines 80 and 82, respectively. FIG. 9 also shows a gasket or liner 84 used to aide in providing a seal. Suitable plastic materials for the closure and suitable gasket materials are well known to persons skilled in the art.

This embodiment of closure 10 is particularly adapted for use in connection with vacuum-packed or pressure-packed container contents. When closure 10 is applied to a package that is hot-filled, as the container contents cool a vacuum is formed in the head space 90 of the container which draws the upper closure surface 12 downwardly to a concave position. This serves the function of causing hinge 18 to become arcuate such that a snap-action is achieved during opening and closing of the container. Additionally, the formed concavity of upper closure surface 12 provides visual evidence that the initial vacuum seal of the container is intact. Alternatively, when the container contents are packaged under pressure, upper closure surface 12 will flex upwardly to a convex orientation (represented by broken line 82). This will also serve to form an arcuate hinge line 18 which has a snap-action, and provides visual evidence that the initial pressure seal in the container is intact.

Figure 10:
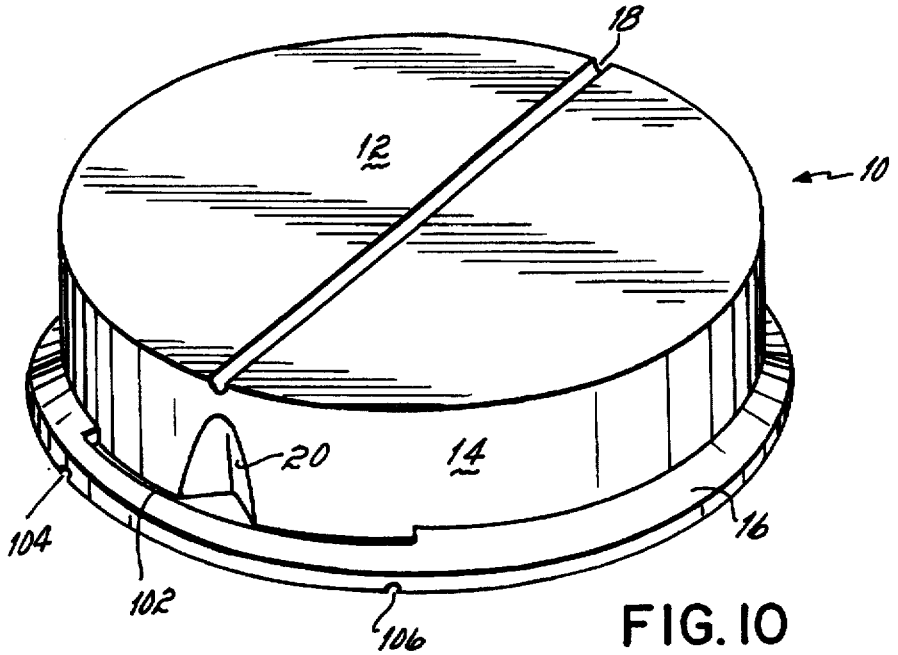
FIG. 10 is a perspective view of another alternative closure of the present invention.
Figure 11:
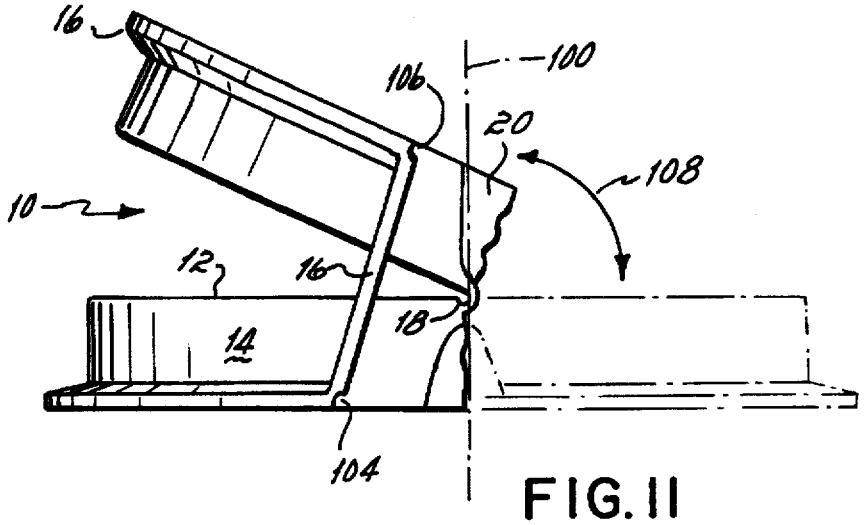
FIG. 11 is a side elevation, in partial phantom, showing the closure of FIG. 10 in an open orientation.

With reference to FIGS. 10 and 11, there is shown another alternative embodiment of the closure 10 of the present invention. In the embodiment shown, tab 16 extends circumferentially about the perimeter of closure 10 and is integral with skirt 14. In this embodiment, however, a secondary hinge member provides the urging or snap action to help snap the closure open and retain it in an open position, as shown in FIG. 11, and to urge or spring the closure to a closed position as it is swung through a vertical reference plane, as represented by dotted line 100. This secondary hinge member comprises two segments of tab 16 wherein tab 16 is unattached to skirt 14, as at gap 102. While only one such gap 102 is shown, it will be appreciated that a corresponding gap is present adjacent the opposite end of hinge 18, but not visible in FIGS. 10 and 11. Two hinge lines 104 and 106 are formed in tab 16 which provide a double jointed hinge that tends to urge or provide a snap action as the closure is flexed about hinge 18. As shown in FIG. 11, the double joint hinge flexes about hinge lines 104 and 106 as the closure is flexed or folded about hinge 18, as represented by arrow 108 in FIG. 11. It will be appreciated that hinge 18 may be a straight line as shown, or may be an arcuate hinge such as that shown in FIG. 4 or FIG. 6.

While the invention has been described and shown with reference to specific embodiments, the scope of the present invention is not intended to be limited to such specifics, but rather is to be construed in accordance with the scope of the appended claims.

What is claimed is:

1. A plastic, tamper-evidencing closure for containers, comprising a circular and substantially planar upper closure surface having a hinge to permit flexing a portion of the closure about the hinge for opening and closing the closure, and a peripheral skin depending from said upper closure surface, said skin including means for retaining the closure on a container and further including tamper evidencing means which is perceptibly disturbed upon first opening of the closure to indicate tampering, wherein said upper closure surface is convex and said hinge bisects said upper surface along an arcuate line within the plane of said upper surface so as to provide a snap-open, spring-closed hinge action.

2. A closure of claim 1, wherein said tamper evidencing means comprises frangible members in a portion of said skirt.

3. A closure of claim 2 wherein said tamper-evidencing means comprises a removable tear strip section in said skirt.

* * * * *